United States Patent [19]

Jahn

[11] Patent Number: 4,727,631

[45] Date of Patent: Mar. 1, 1988

[54] LOCK FOR SAFETY BELTS

[75] Inventor: Walter Jahn, Ehningen, Fed. Rep. of Germany

[73] Assignee: Daimler-Benz Aktiengesellschaft, Stuttgart, Fed. Rep. of Germany

[21] Appl. No.: 32,233

[22] Filed: Mar. 31, 1987

[30] Foreign Application Priority Data

Apr. 3, 1986 [DE] Fed. Rep. of Germany ..... 3611107

[51] Int. Cl.[4] ..... A44B 11/25

[52] U.S. Cl. ..... 24/633; 297/483

[58] Field of Search ..... 24/633, 574, 68 CD, 24/171, 194; 297/483, 468

[56] References Cited

U.S. PATENT DOCUMENTS

| | | | |
|---|---|---|---|
| 1,470,843 | 10/1923 | Johnson | 24/194 |
| 3,453,701 | 7/1969 | Holmberg | 297/483 |
| 4,035,877 | 7/1977 | Brownson et al. | 24/633 |
| 4,616,878 | 10/1986 | Fohl | 297/483 |

FOREIGN PATENT DOCUMENTS

| | | | |
|---|---|---|---|
| 2506297 | 8/1975 | Fed. Rep. of Germany . | |
| 2754481 | 6/1979 | Fed. Rep. of Germany . | |
| 3219712 | 12/1983 | Fed. Rep. of Germany . | |
| 1532589 | 7/1968 | France | 24/633 |

*Primary Examiner*—Victor N. Sakran

*Attorney, Agent, or Firm*—Barnes & Thornburg

[57] ABSTRACT

The invention relates to a lock for safety belts, which is designed to receive a lock tongue provided with a deflection web and is equipped with a press button and which is arranged next to a high storage compartment, center armrest or the like. To make it possible to actuate the lock easily and properly for safety purposes in spite of the high storage compartment located next to it, according to the invention, the top edge of the lock tongue and/or of the press button extends upwards relative to the load bearing deflection web of the lock tongue into the vicinity of the top edge of the storage compartment, center armrest or the like.

6 Claims, 2 Drawing Figures

LOCK FOR SAFETY BELTS

BACKGROUND AND SUMMARY OF THE INVENTION

The invention relates to a lock for safety belts, which is designed to receive a lock tongue provided with a deflection web and with a lock tongue shackle arranged above it and is equipped with a press button and which is arranged next to a high storage compartment, center armrest or the like.

A lock for safety belts with a lock tongue having a lock tongue shackle above its deflection web is shown in German Offenlegungsschrift No. 3,219,712.

The point at which the belt band is deflected in the region of locks of this type of safety belts should be as low as possible, so that the desired restraining effect can be obtained as efficiently as possible. On the other hand, however, this means that it can become more difficult to actuate the belt lock, specifically both pushing in the lock tongue and actuating the press button during opening, because of the adjacent higher constructional parts, such as a storage compartment or the like.

The object of the present invention is to remedy this and, despite a low deflection point for the belt band and a low lock mechanism, guarantee that the lock will be actuated perfectly, easily and properly from the point of view of safety.

In a lock for safety belts of this type, this object is achieved, according to the invention, because the top edge of the lock tongue and/or of the press button are configured to extend upwards relative to the load bearing deflection web of the lock tongue into the vicinity of the top edge of the storage compartment, center armrest or the like.

Other objects, advantages and novel features of the present invention will become appaent from the following detailed description of the invention when considered in conjunction with the accompanying drawings.

DETAILED DESCRIPTION OF THE DRAWINGS

Figure 1:
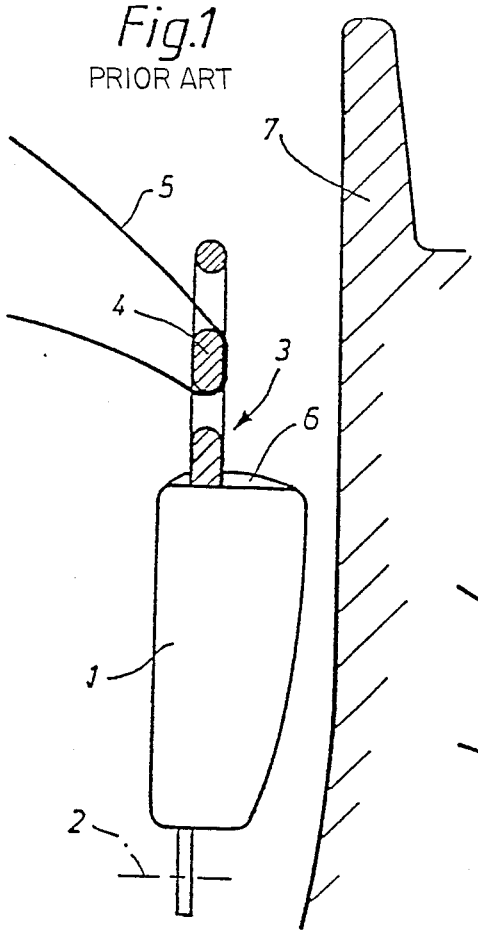
Fig.1 PRIOR ART
FIG. 1 shows a section in a transverse plane of the vehicle through a conventional design and arrangement of a safety belt lock.

FIG. 1 of the drawing shows a lock 1 for a safety belt which is fastened at 2, for example to a vehicle seat (not shown). A lock tongue 3, having a deflection web 4 for a belt band 5, is pushed into the lock 1. The lock tongue 3 is released by actuating a press button 6, but this, like the insertion of the lock tongue 3, can present difficulties because of a higher storage compartment 7 arranged immediately next to it.

Figure 2:
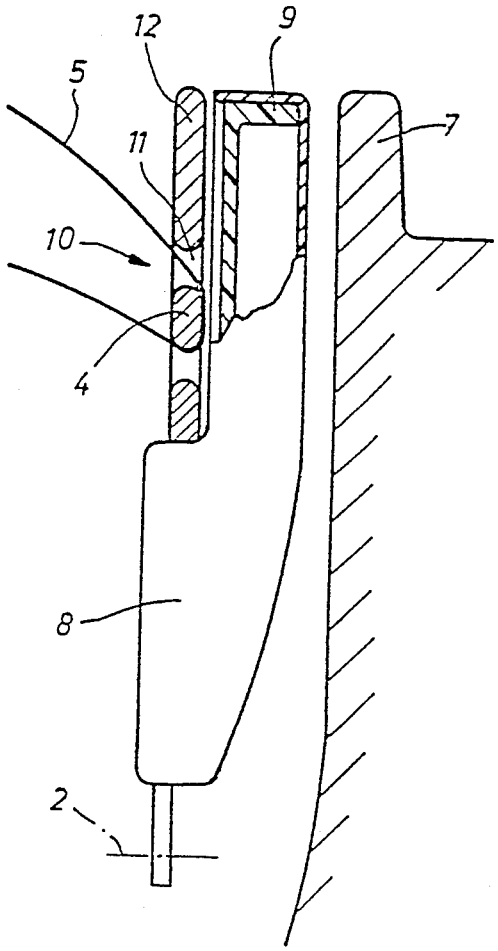
FIG. 2 shows a corresponding section, where a belt lock designed according to the invention is used.

The lock design illustrated in FIG. 2 remedies this.

The lock 8 shown in FIG. 2 is extended upwards until the topsides of its press button 9 and of its lock tongue 10 are approximately the same height as the top edge of the storage compartment 7. The lock tongue 10 is extended as a result of an appropriate design of the lock tongue shackle 12 which limits the passage orifice 11 for the belt band 5 upwards. It should be noted that the vertical position of the deflected web 4 has not changed and that the restraining effect is not changed.

It is not absolutely necessary that, as in the preferred embodiment illustrated, the top edges of the lock tongue and press button on the one hand and of the storage compartment or the like on the other hand should be at the exactly the same height. On the contrary, tests have shown that the belt lock can be actuated without difficulty even when there is a certain difference in height.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Lock for safety belts for a seat, including a lock tongue provided with a deflection web and with a lock tongue shackle arranged above it to be received in a lock housing and a press button on said lock housing both of which are arranged next to a wall adjacent said seat and having a top edge, wherein the top edge of the lock, tongue and the press button extends upwards relative to the deflection web of the lock tongue into the vicinity of and substantially coplanar with the top edge of said wall.

2. A lock according to claim 1, wherein said wall is a wall of a storage compartment.

3. A lock according to claim 1, wherein said wall is a wall of an armrest.

4. Lock for safety belts for a seat, including a lock tongue provided with a deflection web and with a lock tongue shackle arranged above it to be received in a lock housing and a press button on said lock housing both of which are arranged next to a wall adjacent said seat and having a top edge, wherein the press button extends upwards relative to the deflection web of the lock tongue into the vicinity of and substantially coplanar with the top edge of said wall.

5. A lock according to claim 4, wherein said wall is a wall of a storage compartment.

6. A lock according to claim 4, wherein said wall is a wall of an armrest.

* * * * *